US005718429A

United States Patent [19]

Keller, Jr.

[11] Patent Number: 5,718,429

[45] Date of Patent: Feb. 17, 1998

[54] METHOD OF COMBINING A CASINO GAME WITH A GAME OF SKILL

[76] Inventor: Claude Emery Keller, Jr., 7901 Scott La., Rockford, Ill. 61115

[21] Appl. No.: 796,743

[22] Filed: Feb. 6, 1997

[51] Int. Cl.[6] ..... A63F 1/00

[52] U.S. Cl. ..... 273/274; 273/440; 273/459; 463/48

[58] Field of Search ..... 273/274, 118 R, 273/143 R, 138.1, 138.2, 317, 108, 440, 459; 463/12, 13, 20, 48; 473/1, 54, 131, 415, 505, 516

[56] References Cited

U.S. PATENT DOCUMENTS

| | | | |
|---|---|---|---|
| 4,375,286 | 3/1983 | Seitz et al. | 463/48 |
| 4,743,024 | 5/1988 | Helm et al. | 273/143 R |
| 5,393,057 | 2/1995 | Marnell, II | 463/13 |
| 5,409,225 | 4/1995 | Kelly et al. | 273/118 R |
| 5,513,850 | 5/1996 | Vancora | 273/274 |
| 5,566,946 | 10/1996 | Parker | 273/274 |
| 5,603,502 | 2/1997 | Nakagawa | 273/274 |
| 5,607,162 | 3/1997 | Boylan et al. | 273/274 |

*Primary Examiner*—William M. Pierce
*Attorney, Agent, or Firm*—Marshall, O'Toole, Gerstein, Murray & Borun

[57] ABSTRACT

A method for conducting an entertainment in which people may place a stake in a casino game and win a cash prize in a skill game. Stakes in the casino game are placed with chips, which may be purchased in exchange for the services of conducting the casino game. A winning stake is rewarded with a token, rather than with money. A token may be exchanged for an opportunity to demonstrate a skill in the skill game. Those that successfully demonstrate the skill are awarded a cash or other prize. The nature of the prize is correlated to an indicium on the token.

18 Claims, 1 Drawing Sheet

METHOD OF COMBINING A CASINO GAME WITH A GAME OF SKILL

BACKGROUND OF THE INVENTION

Many people are entertained by the excitement of casino games such as roulette, blackjack, and craps as they are played in gambling resorts. One part of the appeal is the possibility of an award of a cash prize. Another part of the appeal is in the play of the game itself.

Many local governments use gambling laws to restrict the use of casino games. Commonly, a casino game may be played for the entertainment that the game itself provides, but may not be played as a game of chance to award a cash prize.

It appears that restrictions on the use of casino games do not arise simply because of the award of cash prizes. Some of the same local governments that preclude the award of cash prizes for games of chance permit the award of cash prizes in other contexts. Under many gambling laws, for example, it is permissible to award a cash prize to a winner of a game requiring physical skill, such as a basketball free-throw shooting contest, a pool shooting contest, or a dart throwing contest. Similarly, many local governments permit a cash prize to be awarded to a winner of a game requiring mental skill, such as a trivia contest. Thus, it appears that it is not the award of cash prizes that most local communities find needs to be restricted, but rather the potential for abuse when a cash prize is awarded for success in a game of chance.

As the success of Las Vegas and Atlantic City can attest, entertainments that combine the excitement of a casino game with the excitement of cash prizes are of great entertainment value to many people. The problem has been to develop a form of entertainment that combines both types of excitement while protecting the concerns of local governments by refraining from the award of cash prizes for success in a game of chance.

BRIEF SUMMARY OF THE INVENTION

The applicant has developed a method for conducting an entertainment that combines part of the excitement of casino games with the excitement of cash prizes, but which prevents the casino game from being utilized as a game of chance. Because the method protects against the potential for abuse that creates concern among many local communities, the method is believed to be particularly advantageous.

The entertainment includes both a casino game and a skill game, and awards cash prizes only in connection with the skill game. Winners of the casino game are awarded only a token, which has no redeemable monetary value. The token merely allows the winner to enter the skill game and, if he or she can demonstrate the necessary skill, entitles the winner to a prize corresponding to an indicium on the token.

DETAILED DESCRIPTION OF THE INVENTION

Figure 1:
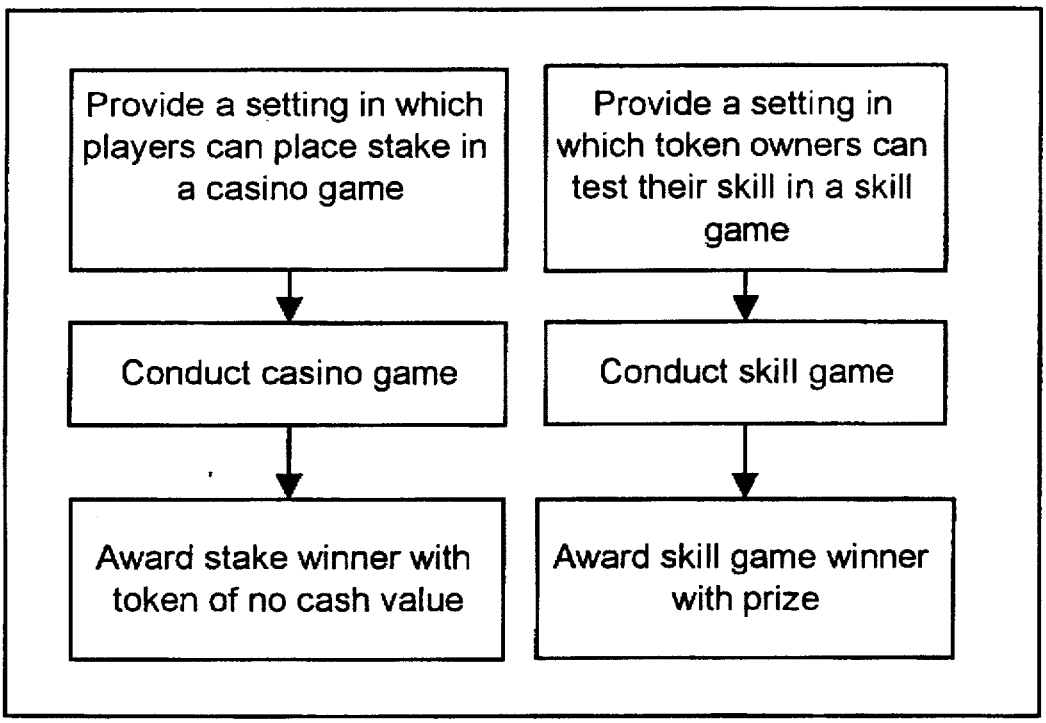
FIG. 1 is a flow chart of a method in accordance with the present invention

As suggested above, the method includes offering individuals opportunities to participate in both a casino game, in which individual stakes are placed, and a skill game, in which prizes are awarded. The entertainment is best described sequentially.

A person conducting the entertainment may, but need not, require individuals to compensate him or her for the services being provided. This can be done in any conventional way, such as selling chips as a form of ticket that can be used by individuals to place a stake in the casino game. The use of chips helps to create the ambiance of a casino, and thus is particularly entertaining. If money is to be collected in return for the services provided, it is preferable that the participants pay a separate price for each stake they will place in the casino game. For example, it is useful to provide tickets worth a particular dollar amount (such as 25 cents), which can be advanced as part of individual stakes in the casino game.

The casino game may be any game in which players may place a stake and in which the determination of whether the stake wins or loses depends upon chance. Because casinos make it their business to find and offer the most entertaining games, it is believed that the most entertaining casino games will be those that are most prevalent in casinos. However, any game that is based substantially on such a game, or is reminiscent of or similar in spirit or play action to such a game, or is even promoted as being like such a game will function as a casino game within the meaning of that term intended here.

Preferably, the casino game is played—except with respect to placing wagers and paying winners—according to conventional rules. It is, of course, possible to modify the rules of the casino game to add interest, but variation from the rules may make the game less entertaining to those individuals familiar with the traditional rules.

In a traditional casino game, winners are awarded money (or its equivalent, chips) for a successful stake. This allows a player to use his or her winnings to pay for continued participation in the casino game. In my method, a winner is not so rewarded. Instead of being awarded money, a winner of a stake in the casino game is awarded one or more tokens that have no redeemable monetary value. Because the tokens have no redeemable value, a winner of a stake in the casino game played under my method will not be able to use his or her winnings to pay for continued participation in the casino game.

Preferably, the token that is provided for a winning stake in the casino game is marked with an indicium, such as a letter, a color, a number, or even a shape. While it is not necessary that a variety of indicia be used, in some instances it may be preferable to use a variety of different types of tokens, each with a different indicium. If tokens having different indicia are used, the type of token awarded for a winning stake could be selected randomly. Preferably, however, the type of token awarded will be correlated to the success of the stake. Success of the stake could be based on any reasonable criterium, but will most preferably be based on the odds that the stake would succeed. For example, a green token could be awarded for winning a stake that has a roughly 50% chance of success, while a silver token is awarded for winning a stake that had a lesser chance of success.

It is possible, though less desirable, to allow some players to pay more than others to participate in the entertainment by placing a stake. When this is done, it may be preferably to correlate the token awarded for a successful stake to the amount paid for the entertainment. For example, one stake winner may have paid 50 cents for the services while another stake winner paid only 25 cents. In those circumstances, it may be desirable to award each winner with a different token.

The token awarded for a winning stake may be used only to obtain access to a physical- or mental-skill game, such as a pool- or basketball-shooting, dart-throwing, or trivia answering. To prevent possible abuse, under no circumstances should it be redeemed by the conductor of the entertainment for money or chips that can be used to continue playing the casino game.

The skill game can be any type of game or event that requires a player to demonstrate real mental or physical skill. Games that do not require real skill will not provide the enhanced entertainment provided by a legitimate skill game. It has been found that people find it to be particularly entertaining if the skill game provides them with three tries to perform a reasonably difficult skill, such as making a basketball free-throw or causing a dart to hit a particular number on a dartboard.

If the individual succeeds in the skill game, he or she is awarded a prize based on an indicium that appears on his or her token. For example, people entering the skill game on a green token may, if successful, be awarded a prize from one category of prizes, while people entering the skill game on a silver token may, if successful, be awarded a prize from a better category of prizes. Preferably, the prizes are cash prizes, and each of the various indicia used on the tokens will correspond with a cash prize of a different dollar amount.

It is possible, though not required, that the skill game also be made available to individuals who do not have tokens. Preferably, such players will, if they successfully perform the skill, be given no more than a modest prize.

This description of my method for entertainment has been only that: a description. Those skilled in the art will appreciate that many modifications can be made to the method without departing from the spirit or scope of the invention, which is set forth in the following claims.

What is claimed is:

1. A method of combining a casino game with a game of skill, the method comprising:

providing a setting in which a player can place a stake in a casino game, the stake having a probability of success;

conducting the casino game;

awarding a winner of a stake in the casino game with a token, the token having no redeemable monetary value;

providing a setting in which a token owner can engage in a skill game in exchange for the token;

conducting the skill game; and awarding a winner of the skill game with a prize.

2. The method of claim 1, in which the player is given chips in order to place a stake in the casino game.

3. The method of claim 1, in which two different types of tokens are used, each with a different indicium.

4. The method of claim 1, in which a winner of a stake in the casino game is awarded a token correlated to successfulness of the stake.

5. The method of claim 1, in which a winner of a stake in the casino game is awarded a token correlated to size of the stake.

6. The method of claim 1, in which a winner of a stake in the casino game is awarded a token correlated to the probability of success of the stake.

7. The method of claim 1, in which a winner of a stake in the casino game is awarded a token correlated to size of the stake and the probability of success of the stake.

8. A method of combining a casino game with a game of skill, the method comprising:

providing a service of conducting a casino game in exchange for an amount of money;

affording a player with an opportunity to place a stake in the casino game, the stake having a probability of success;

awarding a winner of a stake in the casino game with a token, the token having no redeemable monetary value and including an indicium;

affording a token owner with an opportunity to engage in a skill game in exchange for the token;

playing the skill game; and awarding a winner of the skill game with a prize corresponding to the indicium on the token.

9. The method of claim 8, in which the player is given chips in order to place a stake in the casino game.

10. The method of claim 8, in which two different types of tokens are used, each with a different indicium.

11. The method of claim 8, in which a winner of a stake in the casino game is awarded a token correlated to the amount of money the winner paid for the services of conducting the casino game, the probability of success of the stake, or a combination of the amount of money the winner paid for the service and the odds that the stake would succeed.

12. The method of claim 8, in which the skill game provides a player with three chances to successfully perform a skill.

13. A method for conducting a game of skill using rules of a casino game, the method comprising:

providing a service of conducting a casino game and, as part of that service, affording a player with an opportunity to place a stake in the casino game in exchange for a price for the service of conducting the casino game;

awarding a token to a winner of the casino game, the token have no redeemable monetary value;

affording a token owner with an opportunity to engage in a skill game in exchange for the token; and awarding a winner of the skill game with a prize.

14. The method of claim 13, in which the player is given a chip in exchange for the price paid for the service of conducting the casino game.

15. The method of claim 13, in which two different types of tokens are used, each with a different indicium.

16. The method of claim 13, in which:

two different types of tokens are used, each with a different indicium; and the cash prize that is awarded is dependent upon the indicium on the token.

17. The method of claim 13, in which a winner of a stake in the casino game is awarded a token correlated to the amount of money the winner paid for the services of conducting the casino game, the probability of success of the stake, or a combination of the amount of money the winner paid for the service of conducting the casino game and the odds that the stake would succeed.

18. The method of claim 13, in which the skill game provides a participant with three tries to successfully perform a skill.

* * * * *

UNITED STATES PATENT AND TRADEMARK OFFICE

CERTIFICATE OF CORRECTION

PATENT NO. : 5,718,429

DATED : February 17, 1998

INVENTOR(S) : Claude E. Keller, Jr.

It is certified that error appears in the above-identified patent and that said Letters Patent is hereby corrected as shown below:

Column 1, line 59, after "invention" insert --.--

Column 4, claim 11, line 3,

"services" should be "service".

Column 4, claim 17, lines 3,

"services" should be "service".

Signed and Sealed this

Fourth Day of July, 2000

*Attest:*

*Attesting Officer*

Q. TODD DICKINSON

*Director of Patents and Trademarks*